US006739779B1

(12) United States Patent
Deeds

(10) Patent No.: US 6,739,779 B1
(45) Date of Patent: May 25, 2004

(54) FABRIC REPAIR COLORING DEVICE AND METHOD OF USING

(76) Inventor: Suzanne M. Deeds, 3803 Hemphill Rd., Norton, OH (US) 44203

( * ) Notice: Subject to any disclaimer, the term of this patent is extended or adjusted under 35 U.S.C. 154(b) by 0 days.

(21) Appl. No.: 10/369,449

(22) Filed: Feb. 20, 2003

(51) Int. Cl.[7] ..... A46B 11/00; A47L 13/30; D06P 5/02; B67D 5/60

(52) U.S. Cl. ..... 401/47; 401/45; 401/44; 401/264; 8/441; 222/129; 222/132; 222/135; 222/137; 222/144.5; 222/145.1; 222/145.5

(58) Field of Search ..... 401/264, 263, 401/16, 17, 19, 25, 26, 27, 44, 45, 46, 47; 8/441; 222/129, 132, 135, 137, 144.5, 145.1, 145.5

(56) References Cited

U.S. PATENT DOCUMENTS 1,415,718 A * 5/1922 Cantos ..... 401/45
1,749,565 A * 3/1930 Coryell ..... 132/318
2,130,978 A * 9/1938 White ..... 401/45
2,511,369 A * 6/1950 Petit ..... 401/44
4,221,496 A * 9/1980 Anderka et al. ..... 401/258
5,306,092 A * 4/1994 Jenq ..... 401/47
5,971,643 A * 10/1999 Ahmed ..... 401/44

FOREIGN PATENT DOCUMENTS

JP 2-297498 * 2/1990 ..... B43K/5/02

* cited by examiner

*Primary Examiner*—David J. Walczak

(57) ABSTRACT

A fabric repair coloring device and associated method of using the device to coloring unwanted bleached out spots on fabric. The device comprises a plurality of cartridges, an elongated cylindrical casing, a manifold, a rotating cap, and a conical applicator tip. These elements of the device are interconnected to allow a user to select a desired dye color or to mix a plurality of dyes together prior to precisely applying the mixed dyes onto the unwanted bleached out spots on a piece of fabric. The method comprises the steps of finding, obtaining, pressing, pushing, releasing, twisting, wiping, and withdrawing.

20 Claims, 3 Drawing Sheets

FABRIC REPAIR COLORING DEVICE AND METHOD OF USING

FIELD OF THE INVENTION

The present invention relates to fabric repair, more particularly, to a fabric repair coloring device and associated method of using the device to selectively repair unwanted bleach spots on fabric by precisely apply one or more dyes onto these spots.

DESCRIPTION OF THE PRIOR ART

Unwanted bleach spots occur periodically on clothing and other types of fabric when the user unwittingly spills a drop or two of bleach onto these materials. One state of the art result is that the material is ruined simply because these unsightly spots have ruined the appearance of the material. Another prior art technique is to seek out various textile dyes and apply drops of these dyes onto these unwanted bleach spots. Unfortunately, this prior art technique itself might also ruin other nearby fabric because the user might again unwittingly spill a drop or two of the dye onto nearby fabric. Therefore there is a continuing need for an improved method of repairing fabric having unwanted bleach spots.

A wide variety of fabric repair devices is currently available on the commercial market and an even larger number of these types of devices arc known in the art of fabric repair devices, for example, the pen with selective multi-color cores disclosed by Lan in U.S. Pat. No. 4,692,046; the do-it yourself tye-dye kit apparatus and method disclosed by Olphen in U.S. Pat. No. 4,951,483; the method for coloring fabric with crayon disclosed by May in U.S. Pat. No. 5,279,859; the non-mingling multicolor marker and its process disclosed by Sixiong in U.S. Pat. No. 5,368,405; the tie-dyeing kit disclosed by Fromm in U.S. Pat. No. 5,640, 859; and the dual applicator marking instrument disclosed by Lovell in U.S. Pat. No. D295,878.

While all of the above-described devices fulfill their respective, particular objectives and requirements, the aforementioned patents do not describe a fabric repair coloring device having a plurality of cartridges, an elongated cylindrical casing, a manifold, a rotating cap, and a conical applicator tip. This combination of interconnected elements would specifically match the user's particular individual needs of making it possible to allow a user to select a desired dye color or to mix a plurality of dyes together prior to precisely applying the mixed dyes onto the unwanted bleached out spots on a piece of fabric. The above-described patents make no provision for a fabric repair coloring device having a plurality of cartridges, an elongated cylindrical casing, a manifold, a rotating cap, and a conical applicator tip.

Therefore, a need exists for a new and improved fabric repair coloring device having a plurality of cartridges, an elongated cylindrical casing, a manifold, a rotating cap, and a conical applicator tip. In this respect, the fabric repair coloring device according to the present invention substantially departs from the conventional concepts and designs of the prior art, and in doing so provides an apparatus primarily developed for the purpose of providing a convenient means for allowing a user to select a desired dye color or to mix a plurality of dyes together prior to precisely applying the mixed dyes onto the unwanted bleached out spots on a piece of fabric.

SUMMARY OF THE INVENTION

The present device and method of using, according to the principles of the present invention, overcomes the shortcomings of the prior art by providing a fabric repair coloring device and method of using are disclosed. The device comprises a plurality of cartridges, an elongated cylindrical casing, a manifold, a rotating cap, and a conical applicator tip. These elements of the device are interconnected to allow a user to select a desired dye color or to mix a plurality of dyes together prior to precisely applying the mixed dyes onto the unwanted bleached out spots on a piece of fabric. The method comprises the steps of finding, obtaining, pressing, pushing, releasing, twisting, wiping, and withdrawing.

In view of the foregoing disadvantages inherent in the known type fabric repair devices now present in the prior art, the present invention provides an improved fabric repair coloring device, which will be described subsequently in great detail, is to provide a new and improved fabric repair coloring device which is not anticipated, rendered obvious, suggested, or even implied by the prior art, either alone or in any combination thereof.

To attain this, the present invention essentially comprises a plurality of cartridges, an elongated cylindrical casing, a manifold, a rotating cap, and a conical applicator tip. These elements of the device are interconnected to allow a user to select a desired dye color or to mix a plurality of dyes together prior to precisely applying the mixed dyes onto the unwanted bleached out spots on a piece of fabric.

There has thus been outlined, rather broadly, the more important features of the invention in order that the detailed description thereof that follows may be better understood, and in order that the present contribution of the art may be better appreciated. There are of course, additional features of the invention that will be described hereinafter and which will form the subject matter of the claims attached Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fabric repair coloring device that has all the advantages of the prior art fabric repair coloring device and none of the disadvantages.

It is another object of the present invention to provide a new and improved fabric repair coloring device that may be easily and efficiently manufactured and marketed.

An even further object of the present invention is to provide a new and improved fabric repair coloring device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new fabric repair coloring device that provides in the apparatuses and methods of the prior art some of the advantages thererof, while simultaneously overcoming some of the disadvantages normally associated therewith.

Even still another object of the present invention is to provide a fabric repair coloring device having a plurality of cartridges, an elongated cylindrical casing, a manifold, a rotating cap, and a conical applicator tip. This combination of interconnected elements makes it possible to allow a user to select a desired dye color or to mix a plurality of dyes together prior to precisely applying the mixed dyes onto the unwanted bleached out spots on a piece of fabric.

Lastly, it is an object of the present invention to provide a new and improved method of using comprising the steps of finding, obtaining, pressing, pushing, releasing, twisting, wiping, and withdrawing.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
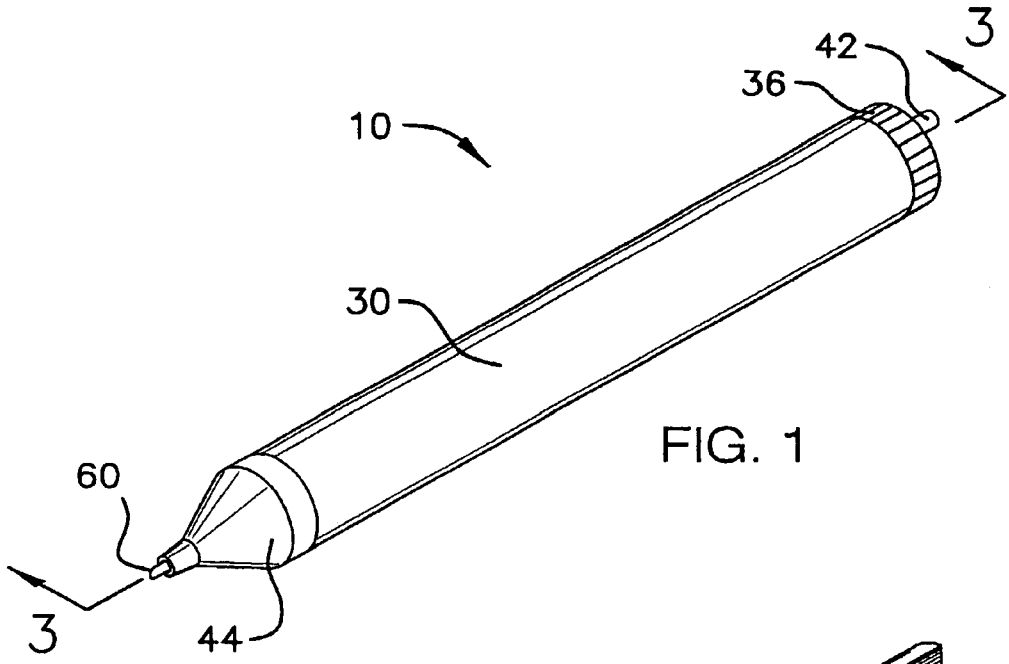
FIG. 1 is a perspective view of a preferred embodiment of the fabric repair coloring device constructed in accordance with the principles of the present invention.

Referring now to the drawings, and in particular FIGS. 1 to 4 thereof, one preferred embodiment of the present invention is shown and generally designated by the reference numeral 10. One preferred embodiment of a fabric repair coloring device 10 for coloring unwanted bleached out spots on fabric, said device 10 comprises a plurality of cartridges 12, an elongated cylindrical casing 30, a manifold 32, a rotating cap 36, and a conical applicator tip 44. Each cartridge 12 of the plurality of cartridges has distal and proximate ends, in which each cartridge 12 includes: a housing 14, a first spring 22, and a nozzle tip 24. The housing 14 has a distal and proximate ends, in which the housing 14 includes: a sleeve 16 in the distal end of the housing 14, the sleeve 16 defining a hole in the distal end of the housing 14; an internal wall attached to the sleeve 16, the internal wall defining a centrally disposed hollow core 18 in the housing 14; and a fluidized dye concoction 20 contained within the hollow core 18 in the housing 14. The first spring 22 is attached to the internal wall of the housing 14. The nozzle tip 24 has a distal and proximate ends, in which the proximate end of the nozzle tip 24 is attached to the first spring 22, a middle portion the nozzle tip 24 is slidably inserted within the hole in the distal end of the housing 14, the nozzle tip 24 has a hollow channel traversing from an exit port 26 in the distal end of the nozzle tip 24 to an entrance port 28 in a side wall in the middle portion of the nozzle tip 24. When the proximate end of the nozzle tip 24 is depressed inwardly into the hollow core 18 of the housing 14 so that the entrance port 28 of the hollow channel in the side wall of the middle portion of the nozzle tip 24 is within the hollow core 18 of the housing 14 then the exit port 26 of the hollow channel of the nozzle tip 24 is in fluid communications with the hollow core 18 of the housing 14. When the distal end of the nozzle tip 24 is distended outwardly away form the distal end of the housing 14 so that the entrance port 28 of the hollow channel in the side wall of the middle portion of the nozzle tip 24 is outside of the hollow core 18 of the housing 14 then the exit port 26 of the hollow channel of the nozzle tip 24 is not in fluid communications with the hollow core 18 of the housing 14. The elongated cylindrical casing 30 has a distal and proximate ends, in which the casing 30 includes a plurality of interior walls defining a plurality of interior chambers, wherein each cartridge 12 of the plurality of cartridges 12 is slidably inserted within each corresponding interior chamber of the plurality of internal chambers of the casing 30. The manifold 32 is attached to the distal end of the casing 30, in which the manifold 32 has a plurality of interior collars 34 traversing through the manifold 32. Each collar 34 of the manifold 32 has a wide section and a narrow section, in which the nozzle tip 24 of each cartridge 12 of the plurality of cartridges 12 is slidably inserted within the wide section of each corresponding collar 34 of the plurality of collars 34 of the manifold 32, wherein the exit port 26 of the nozzle tip 24 is in fluid communications with the wide and narrow sections of each corresponding collar 34 of the plurality of collars 34 of the manifold 32. The rotating cap 36 has proximate and distal ends, in which the rotating cap 36 is pivotally attached to the proximate end of the casing 30, wherein the rotating cap 36 is rotatable around the proximate end of the casing 30. The rotating cap 36 includes: an inner wall, a second spring 40, and a push rod 42. The inner wall of the rotating cap 36 defines a hollow aperture 38. The second spring 40 is attached to the inner wall, in which the second spring 40 is mounted within the hollow aperture 38 of the rotating cap 36. The push rod 42 has a distal end, a proximate end and a middle section, in which the push rod 42 attached to the second spring 40. The middle section of the push rod 42 is disposed within the hollow aperture 38 of the rotating cap 36. The proximate end of the push rod 42 extends outward from the proximate end of the rotating cap 36 and the distal end of the push rod 42 extends outward from the distal end of the rotating cap 36, wherein the distal end of the push rod 42 extends inward into any one interior chamber of the plurality of interior chambers of the cylindrical casing 30. The distal end of the push rod 42 is connectable to the proximate end of anyone of the cartridges 12 of the plurality of cartridges 12 inserted within the plurality of interior chambers of the cylindrical casing 30 when the rotating cap 36 is rotated around the proximate end of the casing 30. When the rotating cap 36 is rotated around the proximate end of the casing 30 so that the distal end of the push rod 42 is aligned directly over the proximate end of any one of the cartridges 12 of the plurality of cartridges 12 inserted within the plurality of interior chambers of the cylindrical casing 30 then the proximate end of the push rod 42 is operatively connected to the proximate end of the nozzle tip 24 of the aligned cartridge 12 so that depressing on the proximate end of the push rod 42 fluidly connects the hollow core 18 of the housing 14 of the aligned cartridge 12 of the plurality of cartridges 12 with of the manifold 32. The conical applicator tip 44 is attached to the distal end of the casing 30, in which the applicator tip 44 includes an inside wall 46, a porous wall 48, a shaft 54, a third spring 56, a plug seal 58, and a probe 60. The porous wall 48 is attached to the inner wall, in which the porous wall 48 has a plurality of pores traversing through the porous wall 48. The inside wall 46 and the porous wall 48 define an aft mixing chamber 50 and a fore mixing chamber 52, in which the fore and aft mixing chambers (52 and 50, respectively) are in fluid communications with each other. The fore and aft mixing chambers (52 and 50, respectively) are also in fluid communications with the each collar 34 of the plurality of interior collars 34 traversing through the manifold 32. The shaft 54 is attached to the porous wall 48, the shaft 54 extending through the fore mixing chamber 52. The third spring 56 is attached to the shaft 54. The plug seal 58 is attached to the third spring 56, in which the plug seal 58 is detachably connected to the inside wall 46. The probe 60 has proximate and distal ends, in which the probe 60 is attached to the plug seal 58. When the proximate end of the probe 60 is pushed towards the fore mixing chamber 52 then the plug seal 58 is detached from the inside wall 46 of the conical applicator tip 44 wherein the proximate end of the probe 60 is in fluidly communications to the fore mixing chamber 52. When the proximate end of the probe 60 is distended away from the fore mixing chamber 52 then the plug seal 58 is connected to the inside wall 46 of the conical applicator tip 44 wherein the proximate end of the probe 60 is not in fluid communications with the fore mixing chamber 52.

Another preferred embodiment of the fabric repair coloring device 10 for coloring unwanted bleached out spots on fabric, the device 10 consisting essentially of: a plurality of cartridges 12, an elongated cylindrical casing 30, a manifold 32, a rotating cap 36, and a conical applicator tip 44.

The dye concoction 20 may be any known dye concoction. Some preferred configuration of the dye concoction are selected from the group consisting of C.I. Acid Blue 1, C.I. Acid Blue 9, C.I. Acid Blue 74, C.I. Acid Blue 92, C.I. Acid Blue 93, C.I. Acid Green 3, C.I. Acid Green 5, C.I. Acid Green 25, C.I. Acid Orange 5, C.I. Acid Orange 6, C.I. Acid Orange 7, C.I. Acid Orange 11, C.I. Acid Orange 20, C.I. Acid Orange 52, C.I. Acid Orange 137, C.I. Acid Red 2, C.I. Acid Red 27, C.I. Acid Red 51, C.I. Acid Red 87, C.I. Acid Red 91, C.I. Acid Red 94, C.I. Acid Red 95, C.I. Acid Red 176, C.I. Acid Violet 19, C.I. Acid Violet 25, C.I. Acid Yellow 1, C.I. Acid Yellow 3, C.I. Acid Yellow 23, C.I. Acid Yellow 36, C.I. Acid Yellow 40, C.I. Acid Yellow 73, C.I. Basic Blue 9, C.I. Basic Blue 17, C.I. Basic Brown 1, C.I. Basic Brown 4, C.I. Basic Green 1, C.I. Basic Green 4, C.I. Basic Orange 2, C.I. Basic Red 5, C.I. Basic Violet 3, C.I. Basic Violet 10, C.I. Basic Violet 14, C.I. Direct Blue 8, C.I. Direct Blue 14, C.I. Direct Blue 53, C.I. Direct Red 2, C.I. Direct Red 28, C.I. Direct Red 34, C.I. Direct Yellow 9, C.I. Mordant Black 11, C.I. Mordant Blue 10, C.I. Mordant Blue 14, C.I. Mordant Orange 1, C.I. Mordant Orange 14, C.I. Mordant Red 3, C.I. Mordant Red 11, C.I. Mordant Violet 26, C.I. Mordant Yellow 1, C.I. Mordant Yellow 5, C.I. Natural Brown 1, C.I. Natural Brown 7, C.I. Natural Red 3, C.I. Natural Red 4, C.I. Natural Red 8, C.I. Natural Red 16, C.I. Natural Red 20, C.I. Natural Red 24, C.I. Natural Red 25, C.I. Natural Red 26, C.I. Natural Yellow 8, C.I. Natural Yellow 11, C.I. Pigment Blue 15, C.I. Pigment Blue 27, C.I. Pigment Blue 29, C.I. Pigment Blue 66, C.I. Pigment Brown 9, C.I. Pigment Green 17, C.I. Pigment Green 21, C.I. Pigment Red 83, C.I. Pigment Red 105, C.I. Pigment Red 106, C.I. Pigment Red 109, C.I. Pigment Violet 14, C.I. Pigment White 1, C.I. Pigment White 4, C.I. Pigment White 5, C.I. Pigment Yellow 31, C.I. Pigment Yellow 33, C.I. Pigment Yellow 34, C.I. Pigment Yellow 36, C.I. Pigment Yellow 39, C.I. Pigment Yellow 40, C.I. Pigment Yellow 45, and mixtures thereof. Another preferred dye concoction 20 is that it is selected from a coloration group consisting of red, blue, violet, green, yellow, and orange.

The housing of the plurality of cartridges 12 may be made of any material. Some preferred configurations of the plurality of cartridges are made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The cylindrical casing 30 may be made of any material. Some preferred configurations of the cylindrical casing 30 are made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The manifold 32 may be made of any material. Some preferred configurations of the manifold 32 are made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The rotating cap 36 may be made of any material. Some preferred configurations of the rotating cap 36 are made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The push rod 42 may be made of any material. Some preferred configurations of the push rod 42 are made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The conical applicator tip 44 may be made of any material. Some preferred configurations of the conical applicator tip 44 are made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

Another preferred embodiment of the fabric repair coloring device 10 for coloring unwanted bleached out spots on fabric, the device 10 consisting essentially of: a plurality of cartridges 12, an elongated cylindrical casing 30, a manifold 32, a rotating cap 36, and a conical applicator tip 44.

One preferred embodiment of a method of using a fabric repair coloring device 10 for coloring unwanted bleached out spots on fabric, the method comprising the steps of: finding, obtaining, pressing, pushing, releasing, twisting, wiping, and withdrawing. The obtaining step comprises obtaining the device 10 comprising: a plurality of cartridges 12, each cartridge 12 having a distal and proximate ends, each cartridge 12 including: a housing 14 having a distal and proximate ends, the housing 14 including: a sleeve 16 in the distal end of the housing 14, the sleeve 16 defining a hole in the distal end of the housing 14; an internal wall attached to the sleeve 16, the internal wall defining a centrally disposed hollow core 18 in the housing 14; and a fluidized dye concoction 20 contained within the hollow core 18 in the housing 14; a first spring 22 attached to the internal wall of the housing 14; and a nozzle tip 24 having a distal and proximate ends, the proximate end of the nozzle tip 24 is attached to the first spring 22, a middle portion the nozzle tip 24 is slidably inserted within the hole in the distal end of the housing 14, the nozzle tip 24 having a hollow channel traversing from an exit port 26 in the distal end of the nozzle tip 24 to an entrance port 28 in a side wall in the middle portion of the nozzle tip 24, when the proximate end of the nozzle tip 24 is depressed inwardly into the hollow core 18 of the housing 14 so that the entrance port 28 of the hollow channel in the side wall of the middle portion of the nozzle tip 24 is within the hollow core 18 of the housing 14 then the exit port 26 of the hollow channel of the nozzle tip 24 is in fluid communications with the hollow core 18 of the housing 14, when the distal end of the nozzle tip 24 is distended outwardly away form the distal end of the housing 14 so that the entrance port 28 of the hollow channel in the side wall of the middle portion of the nozzle tip 24 is outside of the hollow core 18 of the housing 14 then the exit port 26 of the hollow channel of the nozzle tip 24 is not in fluid communications with the hollow core 18 of the housing 14; wherein the plurality of cartridges 12 comprises a first cartridge 12 with the corresponding dye concoction 20 having a first coloration, a second cartridge 12 with the corresponding dye concoction 20 having a second coloration, and a third cartridge 12 with the corresponding dye concoction 20 having a third coloration; an elongated cylindrical casing 30 having a distal and proximate ends, the casing 30 including a plurality of interior walls defining a plurality of interior chambers, wherein each cartridge 12 of the plurality of cartridges 12 is slidably inserted within each corresponding interior chamber of the plurality of internal chambers of the casing 30; a manifold 32 attached to the distal end of the casing 30, the manifold 32 having a plurality of interior collars 34 traversing through the manifold 32, each collar 34 having a wide section and a narrow section, the nozzle tip 24 of each cartridge 12 of the plurality of cartridges 12 is slidably inserted within the wide section of each corresponding collar 34 of the plurality of collars 34 of the manifold 32, wherein the exit port 26 of the nozzle tip 24 is in fluid communications with the wide and narrow sections of each corresponding collar 34 of the plurality of collars 34 of the manifold 32; a rotating cap 36 having a proximate and distal ends, the rotating cap 36 pivotally attached to the proximate end of the casing 30, wherein the rotating cap 36 is rotatable around the proximate end of the casing 30, the rotating cap 36 including: an inner wall defining a hollow aperture 38; a second spring 40 attached to the inner wall, the second spring 40 mounted within the hollow aperture 38 of the rotating cap 36; and a push rod 42 having a distal end, a proximate end and a middle section, the push rod 42 attached to the second spring 40, the middle section of the push rod 42 is disposed within the hollow aperture 38 of the rotating cap 36, the proximate end of the push rod 42 extends outward from the proximate end of the rotating cap 36, the distal end of the push rod 42 extends outward from the distal end of the rotating cap 36, the distal end of the push rod 42 extends inward into anyone interior chamber of the plurality of interior chambers of the cylindrical casing 30, wherein the distal end of the push rod 42 is connectable to the proximate end of any one of the cartridges 12 of the plurality of cartridges 12 inserted within the plurality of interior chambers of the cylindrical casing 30 when the rotating cap 36 is rotated around the proximate end of the casing 30, wherein when the rotating cap 36 is rotated around the proximate end of the casing 30 so that the distal end of the push rod 42 is aligned directly over the proximate end of anyone of the cartridges 12 of the plurality of cartridges 12 inserted within the plurality of interior chambers of the cylindrical casing 30 then the proximate end of the push rod 42 is operatively connected to the proximate end of the nozzle tip 24 of the aligned cartridge 12 so that depressing on the proximate end of the push rod 42 fluidly connects the hollow core 18 of the housing 14 of the aligned cartridge 12 of the plurality of cartridges 12 with the manifold 32; and a conical applicator tip 44 attached to the distal end of the casing 30, the applicator tip 44 including: an inside wall 46; a porous wall 48 attached to the inner wall, the porous wall 48 having a plurality of pores traversing through the porous wall 48, wherein the inside wall 46 and the porous wall 48 defining an aft mixing chamber 50 and a fore mixing chamber 52, the fore and aft mixing chambers (52 and 50, respectively) are in fluid communications with each other, the fore and aft mixing chambers (52 and 50, respectively) are in fluid communications with the each collar 34 of the plurality of interior collars 34 traversing through the manifold 32; a shaft 54 attached to the porous wall 48, the shaft 54 extending through the fore mixing chamber 52; a third spring 56 attached to the shaft 54; a plug seal 58 attached to the third spring 56, the plug seal 58 is detachably connected to the inside wall 46; and a probe 60 having a proximate and distal ends, the probe 60 is attached to the plug seal 58, when the proximate end of the probe 60 is pushed towards the fore mixing chamber 52 then the plug seal 58 is detached from the inside wall 46 of the conical applicator tip 44 wherein the proximate end of the probe 60 is in fluidly communications to the fore mixing chamber 52, when the proximate end of the probe 60 is distended away from the fore mixing chamber 52 then the plug seal 58 is connected to the inside wall 46 of the conical applicator tip 44 wherein the proximate end of the probe 60 is not in fluid communications with the fore mixing chamber 52. The finding step comprises finding a first piece of colored clothing having a first coloration and a first bleach spot. The twisting step comprises twisting rotationally the rotating cap 36 so that the distal end of the push rod 42 is aligned directly over the proximate end of the first cartridge 12 of the plurality of cartridges 12 inserted within the plurality of interior chambers of the cylindrical casing 30. The pushing step comprises pushing down onto the proximate end of the push rod 42 so that the distal end of the push rod 42 forces the proximate end of the nozzle tip 24 of the first cartridge 12 to slidably depress inwardly into the hollow core 18 of the housing 14 of the first cartridge 12 so that the entrance port 28 of the hollow channel in the side wall of the nozzle tip 24 of the first cartridge 12 is in fluid communications with the hollow core I 8 of the housing 14 of the first cartridge 12 wherein allowing the dye concoction 20 in the hollow chamber of the first cartridge 12 to flow through the manifold 32 and into the aft mixing chamber 50 of the applicator tip 44. The pressing step comprises pressing down on the first bleach spot of the first piece of clothing with the probe 60 so that the proximate end of the probe 60 is forced towards the fore mixing chamber 52 wherein allowing a portion of the dye concoction 20 in the aft mixing chamber 50 to flow into the fore mixing chamber 52 of the applicator tip 44 and out of the applicator tip 44 onto the first bleach spot of the first piece of clothing. The releasing step comprises releasing the proximate end of the push rod 42 so that the first spring 22 of the first cartridge 12 is allowed to force the distal end of the nozzle tip 24 of the first cartridge 12 to distend outwardly away from the distal end of the housing 14 of the first cartridge 12 so that the entrance port 28 of the hollow channel in the side wall of the middle portion of the nozzle tip 24 of the first cartridge 12 is outside of the hollow core 18 of the housing 14 of the first cartridge 12. The withdrawing step comprises withdrawing the device 10 from the first piece of clothing. The wiping step comprises wiping off the applicator tip 44 to remove any residual dye concoction 20.

Another preferred embodiment of the method consist essentially of the steps of: finding, obtaining, pressing, pushing, releasing, twisting, wiping, and withdrawing.

An optional set of steps may be added to the method comprising the steps of: cleaning, depressing, driving, freeing, locating, revolving, and taking. The locating step comprises locating a second piece of colored clothing having a second coloration and a second bleach spot revolving rotationally the rotating cap 36 so that the distal end of the push rod 42 is aligned directly over the proximate end of the second cartridge 12 of the plurality of cartridges 12 inserted within the plurality of interior chambers of the cylindrical casing 30. The driving step comprises driving down onto the proximate end of the push rod 42 so that the distal end of the push rod 42 forces the proximate end of the nozzle tip 24 of the second cartridge 12 to slidably depress inwardly into the hollow core 18 of the housing 14 of the second cartridge 12 so that the entrance port 28 of the hollow channel in the side wall of the nozzle tip 24 of the second cartridge 12 is in fluid communications with the hollow core 18 of the housing 14 of the second cartridge 12 wherein allowing the dye concoction 20 in the hollow chamber of the second cartridge 12 to flow through the manifold 32 and into the aft mixing chamber 50 of the applicator tip 44. The depressing step comprises depressing on the second bleach spot of the second piece of clothing with the probe 60 so that the proximate end of the probe 60 is forced towards the fore mixing chamber 52 wherein allowing a portion of the dye concoction 20 in the aft mixing chamber 50 to flow into the fore mixing chamber 52 of the applicator tip 44 and out of the applicator tip 44 onto the second bleach spot of the second piece of clothing. The freeing step comprises freeing up the proximate end of the push rod 42 so that the first spring 22 of the second cartridge 12 is allowed to force the distal end of the nozzle tip 24 of the second cartridge 12 to distend outwardly away from the distal end of the housing 14 of the second cartridge 12 so that the entrance port 28 of the hollow channel in the side wall of the middle portion of the nozzle tip 24 of the second cartridge 12 is outside of the hollow core 18 of the housing 14 of the second cartridge 12. The taking step comprises taking away the device 10 from the second piece of clothing. The cleaning step comprises cleaning off the applicator tip 44 to remove any residual dye concoction 20.

An optional set of steps may be added to the method comprising the steps of: cramming, discharging, discovering, gyrating, moving, and ramming. The discovering step comprises discovering a third piece of colored clothing having a third coloration and a third bleach spot. The gyrating step comprises gyrating rotationally the rotating cap 36 so that the distal end of the push rod 42 is aligned directly over the proximate end of the third cartridge 12 of the plurality of cartridges 12 inserted within the plurality of interior chambers of the cylindrical casing 30. The ramming step comprises ramming down onto the proximate end of the push rod 42 so that the distal end of the push rod 42 forces the proximate end of the nozzle tip 24 of the third cartridge 12 to slidably depress inwardly into the hollow core 18 of the housing 14 of the third cartridge 12 so that the entrance port 28 of the hollow channel in the side wall of the nozzle tip 24 of the third cartridge 12 is in fluid communications with the hollow core 18 of the housing 14 of the third cartridge 12 wherein allowing the dye concoction 20 in the hollow chamber of the third cartridge 12 to flow through the manifold 32 and into the aft mixing chamber 50 of the applicator tip 44. The cramming step comprises cramming down on the third bleach spot of the third piece of clothing with the probe 60 so that the proximate end of the probe 60 is forced towards the fore mixing chamber 52 wherein allowing a portion of the dye concoction 20 in the aft mixing chamber 50 to flow into the fore mixing chamber 52 of the applicator tip 44 and out of the applicator tip 44 onto the third bleach spot of the third piece of clothing. The discharging step comprises discharging the proximate end of the push rod 42 so that the first spring 22 of the third cartridge 12 is allowed to force the distal end of the nozzle tip 24 of the third cartridge 12 to distend outwardly away from the distal end of the housing 14 of the third cartridge 12 so that the entrance port 28 of the hollow channel in the side wall of the middle portion of the nozzle tip 24 of the third cartridge 12 is outside of the hollow core 18 of the housing 14 of the third cartridge 12. The moving step comprises moving the device 10 away from the third piece of clothing.

Referring now to FIG. 1, which depicts a perspective view of an preferred embodiment of the fabric repair coloring device 10 showing an elongated cylindrical casing 30, a rotating cap 36, and a conical applicator tip 44. The rotating cap 36 is shown having a push rod 42. The conical applicator tip 44 is shown having a probe 60 extending from it.

Figure 2:
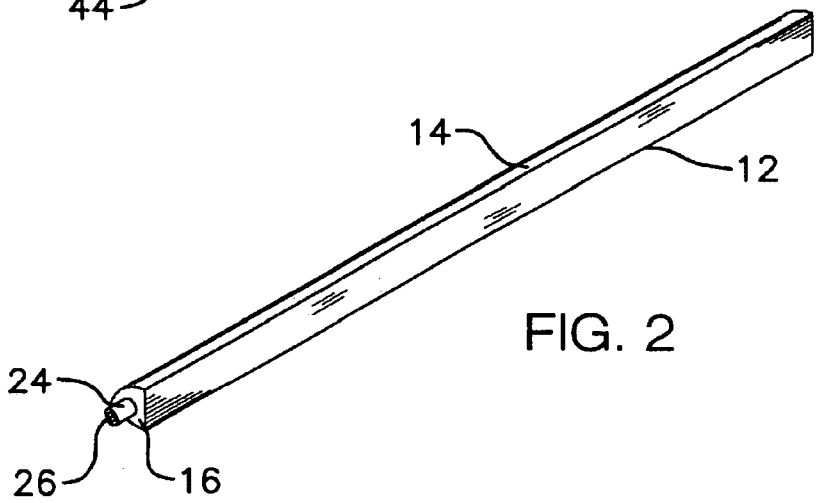
FIG. 2 is a perspective view of a preferred embodiment of the fabric repair coloring device of the present invention.

Referring now to FIG. 2 which depicts is a perspective view of a cartridges 12 of a preferred embodiment of the fabric repair coloring device 10 showing: a housing 14 and a nozzle tip 24. The housing 14 is shown having a sleeve 16 in the distal end of the housing 14, the sleeve 16. The nozzle tip 24 is shown having a middle portion the nozzle tip 24 slidably inserted within the hole in the distal end of the housing 14. The nozzle tip 24 is also shown having a hollow channel traversing at an exit port 26 in the distal end of the nozzle tip 24.

Figure 3:
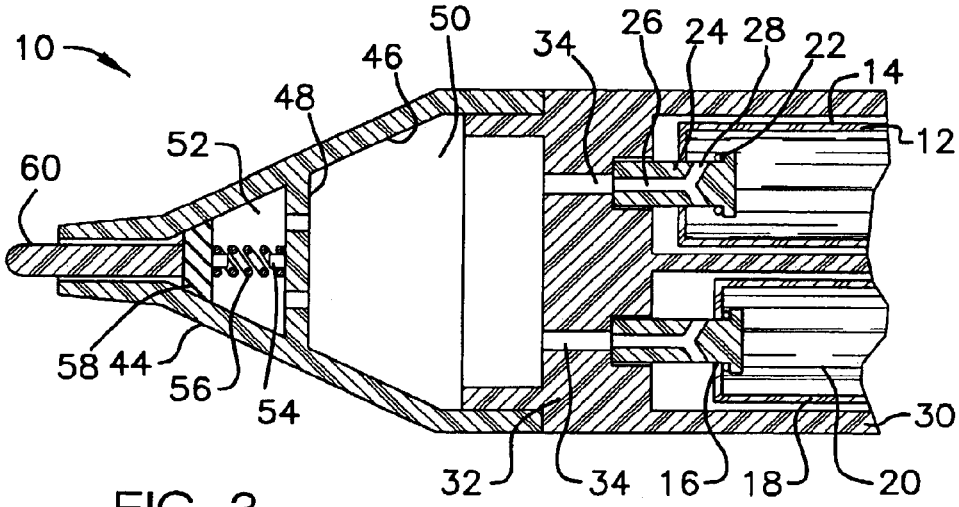
FIG. 3 is a distal end cross sectional side view of a preferred embodiment of the fabric repair coloring device of the present invention.

Referring now to FIG. 3 which depicts a distal end cross sectional side view of a preferred embodiment of the fabric repair coloring device 10 showing a plurality of cartridges 12, an elongated cylindrical casing 30, a manifold 32, and a conical applicator tip 44. Each cartridge 12 of the plurality of cartridges is shown having a housing 14, a first spring 22, and a nozzle tip 24. The housing 14 is shown having a sleeve 16 in the distal end of the housing 14, in which the sleeve 16 defines a hole in the distal end of the housing 14; an internal wall attached to the sleeve 16, the internal wall defines a centrally disposed hollow core 18 in the housing 14; and a fluidized dye concoction 20 contained within the hollow core 18 in the housing 14. The first spring 22 is shown attached to the internal wall of the housing 14. The nozzle tip 24 is shown attached to the first spring 22, a middle portion the nozzle tip 24 is shown slidably inserted within the hole in the distal end of the housing 14, the nozzle tip 24 is shown having a hollow channel traversing from an exit port 26 in the distal end of the nozzle tip 24 to an entrance port 28 in a side wall in the middle portion of the nozzle tip 24. The elongated cylindrical casing 30 is shown having a plurality of interior walls defining a plurality of interior chambers, wherein each cartridge 12 of the plurality of cartridges 12 is shown slidably inserted within each corresponding interior chamber of the plurality of internal chambers of the casing 30. The manifold 32 is shown attached to the distal end of the casing 30, in which the manifold 32 is shown having a plurality of interior collars 34 traversing through the manifold 32. Each collar 34 of the manifold 32 is shown having a wide section and a narrow section, in which the nozzle tip 24 of each cartridge 12 of the plurality of cartridges 12 is shown slidably inserted within the wide section of each corresponding collar 34 of the plurality of collars 34 of the manifold 32, wherein the exit port 26 of the nozzle tip 24 is in fluid communications with the wide and narrow sections of each corresponding collar 34 of the plurality of collars 34 of the manifold 32. The conical applicator tip 44 is shown attached to the distal end of the casing 30. The applicator tip 44 is shown having an inside wall 46, a porous wall 48, a shaft 54, a third spring 56, a plug seal 58, and a probe 60. The porous wall 48 is shown attached to the inner wall, in which the porous wall 48 has a plurality of pores traversing through the porous wall 48. The inside wall 46 and the porous wall 48 define an aft mixing chamber 50 and a fore mixing chamber 52, in which the fore and aft mixing chambers (50 and 52, respectively) are in fluid communications with each other, The fore and aft mixing chambers (50 and 52, respectively) are also in fluid communications with the each collar 34 of the plurality of interior collars 34 traversing through the manifold 32. The shaft 54 is shown attached to the porous wall 48, the shaft 54 extending through the fore mixing chamber 52. The third spring 56 is shown attached to the shaft 54. The plug seal 58 is shown attached to the third spring 56, in which the plug seal 58 is detachably connected to the inside wall 46. The probe 60 is shown attached to the plug seal 58.

Figure 3A:
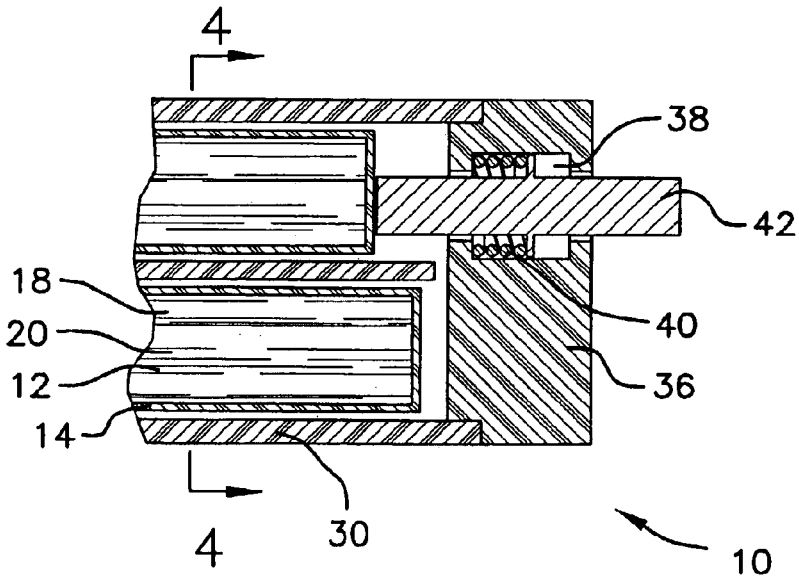
FIG. 3*a* is a proximate end cross sectional side view of a preferred embodiment of the fabric repair coloring device of the present invention.

Referring now to FIG. 3*a* which depicts a proximate end cross sectional side view of a preferred embodiment of the fabric repair coloring device showing a plurality of cartridges 12, an elongated cylindrical casing 30, and a rotating cap 36. Each cartridge 12 of the plurality of cartridges is shown to include a housing 14, in which the housing 14 has an internal wall internal wall defining a centrally disposed hollow core 18 in the housing 14 and a fluidized dye concoction 20 contained within the hollow core 18 in the housing 14. The elongated cylindrical casing 30 is shown having a plurality of interior walls defining a plurality of interior chambers, wherein each cartridge 12 of the plurality of cartridges 12 is shown slidably inserted within each corresponding interior chamber of the plurality of internal chambers of the casing 30. The rotating cap 36 is shown pivotally attached to the proximate end of the casing 30, wherein the rotating cap 36 is rotatable around the proximate end of the casing 30. The rotating cap 36 is shown to includes: an inner wall, a second spring 40, and a push rod 42. The inner wall of the rotating cap 36 is shown to define a hollow aperture 38. The second spring 40 is shown attached to the inner wall, in which the second spring 40 is shown mounted within the hollow aperture 38 of the rotating cap 36. The push rod 42 is shown attached to the second spring 40. The middle section of the push rod 42 is shown disposed within the hollow aperture 38 of the rotating cap 36. The proximate end of the push rod 42 is shown extending outward from the proximate end of the rotating cap 36 and the distal end of the push rod 42 is shown extending outward from the distal end of the rotating cap 36, wherein the distal end of the push rod 42 is shown extending inward into anyone interior chamber of the plurality of interior chambers of the cylindrical casing 30. The distal end of the push rod 42 is shown to be connectable to the proximate end of anyone of the cartridges 12 of the plurality of cartridges 12 inserted within the plurality of interior chambers of the cylindrical casing 30 when the rotating cap 36 is rotated around the proximate end of the casing 30. When the rotating cap 36 is rotated around the proximate end of the casing 30 so that the distal end of the push rod 42 may be aligned directly over the proximate end of anyone of the cartridges 12 of the plurality of cartridges 12 inserted within the plurality of interior chambers of the cylindrical casing 30.

Figure 4:
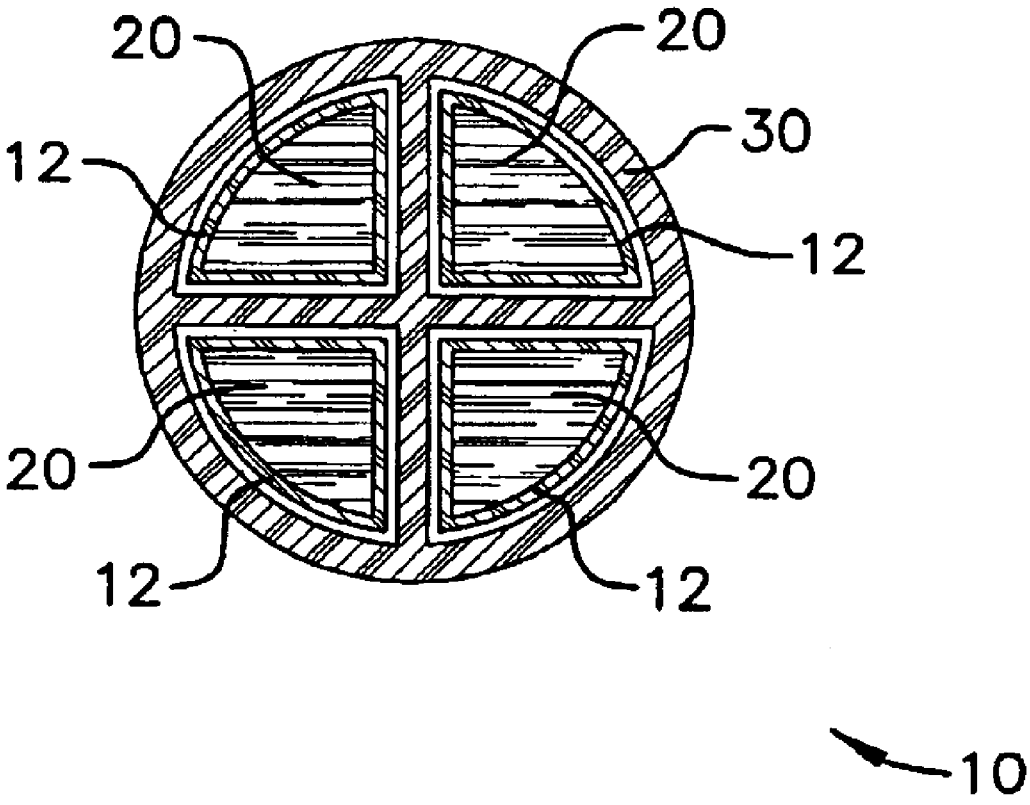
FIG. 4 is a cross sectional lateral view of a preferred embodiment of the fabric repair coloring device of the present invention.

Referring now to FIG. 4 which depicts a cross sectional lateral view of a preferred embodiment of the fabric repair coloring device 10 showing a plurality of cartridges 12, and an elongated cylindrical casing 30. Each cartridge 12 of the plurality of cartridges is shown to include: a housing 14 having an internal wall internal wall defining a centrally disposed hollow core 18 in the housing 14; and a fluidized dye concoction 20 contained within the hollow core 18 in the housing 14. The elongated cylindrical casing 30 is shown to includes a plurality of interior walls defining a plurality of interior chambers, wherein each cartridge 12 of the plurality of cartridges 12 is shown slidably inserted within each corresponding interior chamber of the plurality of internal chambers of the casing 30.

As to the manner of usage and operation of the present invention, the same should be apparent from the above description. Accordingly, no further discussion relating to the manner of usage and operation will be provided.

While a preferred embodiment of the fabric repair coloring device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications that fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fabric repair device for repairing unwanted bleached out spots on fabric, said device comprising:

a plurality of cartridges, each cartridge having a distal and proximate ends, each cartridge including:

a housing having distal and proximate ends, said housing including:

a sleeve in the distal end of said housing, said sleeve defining a hole in the distal end of said housing;

an internal wall attached to said sleeve, said internal wall defining a centrally disposed hollow core in said housing; and a fluidized dye concoction contained within said hollow core in said housing;

a first spring attached to said internal wall of said housing; and a nozzle tip having a distal and proximate ends, the proximate end of said nozzle tip is attached to said first spring, a middle portion said nozzle tip is slidably inserted within the hole in the distal end of said housing, said nozzle tip having a hollow channel traversing from an exit port in the distal end of said nozzle tip to an entrance port in a side wall in the middle portion of said nozzle tip, when the proximate end of said nozzle tip is depressed inwardly into said hollow core of said housing so that said entrance port of said hollow channel in the side wall of the middle portion of said nozzle tip is within said hollow core of said housing then said exit port of said hollow channel of said nozzle tip is in fluid communications with said hollow core of said housing, when the distal end of said nozzle tip is distended outwardly away form the distal end of said housing so that said entrance port of said hollow channel in the side wall of the middle portion of said nozzle tip is outside of said hollow core of said housing then said exit port of said hollow channel of said nozzle tip is not in fluid communications with said hollow core of said housing;

an elongated cylindrical casing having a distal and proximate ends, said casing including a plurality of interior walls defining a plurality of interior chambers, wherein each cartridge of said plurality of cartridges is slidably inserted within each corresponding interior chamber of said plurality of internal chambers of said casing;

a manifold attached to the distal end of said casing, said manifold having a plurality of interior collars traversing through said manifold, each collar having a wide section and a narrow section, said nozzle tip of each cartridge of said plurality of cartridges is slidably inserted within the wide section of each corresponding collar of said plurality of collars of said manifold, wherein said exit port of said nozzle,tip is in fluid communications with said wide and narrow sections of each corresponding collar of said plurality of collars of said manifold;

a rotating cap having a proximate and distal ends, said rotating cap pivotally attached to the proximate end of said casing, wherein said rotating cap is rotatable around the proximate end of said casing, said rotating cap including:

an inner wall defining a hollow aperture;

a second spring attached to said inner wall, said second spring mounted within said hollow aperture of said rotating cap; and a push rod having a distal end, a proximate end and a middle section, said push rod attached to said second spring, said middle section of said push rod is disposed within said hollow aperture of said rotating cap, the proximate end of said push rod extends outward from the proximate end of said rotating cap, the distal end of said push rod extends outward from the distal end of said rotating cap, the distal end of said push rod extends inward into any one interior chamber of said plurality of interior chambers of said cylindrical casing, wherein the distal end of said push rod is connectable to the proximate end of any one of said cartridges of said plurality of cartridges inserted within said plurality of interior chambers of said cylindrical casing when said rotating cap is rotated around the proximate end of said casing, wherein when said rotating cap is rotated around the proximate end of said casing so that the distal end of said push rod is aligned directly over the proximate end of any one of said cartridges of said plurality of cartridges inserted within said plurality of interior chambers of said cylindrical casing then the proximate end of said push rod is operatively connected to the proximate end of said nozzle tip of the aligned cartridge so that depressing on the proximate end of said push rod fluidly connects said hollow core of said housing of said aligned cartridge of said plurality of cartridges with said manifold;

a conical applicator tip attached to the distal end of said casing, said applicator tip including:

an inside wall;

a porous wall attached to said inner wall, said porous wall having a plurality of pores traversing through said porous wall, wherein said inside wall and said porous wall defining an aft mixing chamber and a fore mixing chamber, said fore and aft mixing chambers are in fluid communications with each other, said fore and aft mixing chambers are in fluid communications with said each collar of said plurality of interior collars traversing through said manifold;

a shaft attached to said porous wall, said shaft extending through said fore mixing chamber;

a third spring attached to said shaft;

a plug seal attached to said third spring, said plug seal is detachably connected to said inside wall; and a probe having a proximate and distal ends, said probe is attached to said plug seal, when the proximate end of said probe is pushed towards said fore mixing chamber then said plug seal is detached from said inside wall of said conical applicator tip wherein the proximate end of said probe is in fluidly communications to said fore mixing chamber, when the proximate end of said probe is distended away from said fore mixing chamber then said plug seal is connected to said inside wall of said conical applicator tip wherein the proximate end of said probe is not in fluid communications with said fore mixing chamber.

2. The device of claim 1 wherein said dye concoction is selected from the group consisting of C.I. Acid Blue 1, C.I. Acid Blue 9, C.I. Acid Blue 74, C.I. Acid Blue 92, C.I. Acid Blue 93, C.I. Acid Green 3, C.I. Acid Green 5, C.I. Acid Green 25, C.I. Acid Orange 5, C.I. Acid Orange 6, C.I. Acid Orange 7, C.I. Acid Orange 11, C.I. Acid Orange 20, C.I. Acid Orange 52, C.I. Acid Orange 137, C.I. Acid Red 2, C.I. Acid Red 27, C.I. Acid Red 51, C.I. Acid Red 87, C.I. Acid Red 91, C.I. Acid Red 94, C.I. Acid Red 95, C.I. Acid Red 176, C.I. Acid Violet 19, C.I. Acid Violet 25, C.I. Acid Yellow 1, C.I. Acid Yellow 3, C.I. Acid Yellow 23, C.I. Acid Yellow 36, C.I. Acid Yellow 40, C.I. Acid Yellow 73, C.I. Basic Blue 9, C.I. Basic Blue 17, C.I. Basic Brown 1, C.I. Basic Brown 4, C.I. Basic Green 1, C.I. Basic Green 4, C.I. Basic Orange 2, C.I. Basic Red 5, C.I. Basic Violet 3, C.I. Basic Violet 10, C.I. Basic Violet 14, C.I. Direct Blue 8, C.I. Direct Blue 14, C.I. Direct Blue 53, C.I. Direct Red 2, C.I. Direct Red 28, C.I. Direct Red 34, C.I. Direct Yellow 9, C.I. Mordant Black 11, C.I. Mordant Blue 10, C.I. Mordant Blue 14, C.I. Mordant Orange 1, C.I. Mordant Orange 14, C.I. Mordant Red 3, C.I. Mordant Red 11, C.I. Mordant Violet 26, C.I. Mordant Yellow 1, C.I. Mordant Yellow 5, C.I. Natural Brown 1, C.I. Natural Brown 7, C.I. Natural Red 3, C.I. Natural Red 4, C.I. Natural Red 8, C.I. Natural Red 16, C.I. Natural Red 20, C.I. Natural Red 24, C.I. Natural Red 25, C.I. Natural Red 26, C.I. Natural Yellow 8, C.I. Natural Yellow 1, C.I. Pigment Blue 15, C.I. Pigment Blue 27, C.I. Pigment Blue 29, C.I. Pigment Blue 66, C.I. Pigment Brown 9, C.I. Pigment Green 17, C.I. Pigment Green 21, C.I. Pigment Red 83, C.I. Pigment Red 105, C.I. Pigment Red 106, C.I. Pigment Red 109, C.I. Pigment Violet 14, C.I. Pigment White 1, C.I. Pigment White 4, C.I. Pigment White 5, C.I. Pigment Yellow 31, C.I. Pigment Yellow 33, C.I. Pigment Yellow 34, C.I. Pigment Yellow 36, C.I. Pigment Yellow 39, C.I. Pigment Yellow 40, C.I. Pigment Yellow 45, and mixtures thereof.

3. The device of claim 1 wherein said housing of said plurality of cartridges is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

4. The device of claim 1 wherein said cylindrical casing is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

5. The device of claim 1 wherein said manifold is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

6. The device of claim 1 wherein said rotating cap is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

7. The device of claim 1 wherein said push rod is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

8. The device of claim 1 wherein said conical applicator tip is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

9. The device of claim 1 wherein said plurality of cartridges comprises four cartridges.

10. The device of claim 1 wherein said dye concoction is selected from a coloration group consisting of red, blue, violet, green, yellow, and orange.

11. A fabric repair coloring device for coloring unwanted bleached out spots on fabric, said device consisting essentially of:

a plurality of cartridges, each cartridge having distal and proximate ends, each cartridge including:

a housing having distal and proximate ends, said housing including:

a sleeve in the distal end of said housing, said sleeve defining a hole in the distal end of said housing;

an internal wall attached to said sleeve, said internal wall defining a centrally disposed hollow core in said housing; and a fluidized dye concoction contained within said hollow core in said housing;

a first spring attached to said internal wall of said housing; and a nozzle tip having a distal and proximate ends, the proximate end of said nozzle tip is attached to said first spring, a middle portion said nozzle tip is slidably inserted within the hole in the distal end of said housing, said nozzle tip having a hollow channel traversing from an exit port in the distal end of said nozzle tip to an entrance port in a side wall in the middle portion of said nozzle tip, when the proximate end of said nozzle tip is depressed inwardly into said hollow core of said housing so that said entrance port of said hollow channel in the side wall of the middle portion of said nozzle tip is within said hollow core of said housing then said exit port of said hollow channel of said nozzle tip is in fluid communications with said hollow core of said housing, when the distal end of said nozzle tip is distended outwardly away form the distal end of said housing so that said entrance port of said hollow channel in the side wall of the middle portion of said nozzle tip is outside of said hollow core of said housing then said exit port of said hollow channel of said nozzle tip is not in fluid communications with said hollow core of said housing;

an elongated cylindrical casing having a distal and proximate ends, said casing including a plurality of interior walls defining a plurality of interior chambers, wherein each cartridge of said plurality of cartridges is slidably inserted within each corresponding interior chamber of said plurality of internal chambers of said casing;

a manifold attached to the distal end of said casing, said manifold having a plurality of interior collars traversing through said manifold, each collar having a wide section and a narrow section, said nozzle tip of each cartridge of said plurality of cartridges is slidably inserted within the wide section of each corresponding collar of said plurality of collars of said manifold, wherein said exit port of said nozzle tip is in fluid communications with said wide and narrow sections of each corresponding collar of said plurality of collars of said manifold;

a rotating cap having a proximate and distal ends, said rotating cap pivotally attached to the proximate end of said casing, wherein said rotating cap is rotatable around the proximate end of said casing, said rotating cap including:

an inner wall defining a hollow aperture;

a second spring attached to said inner wall, said second spring mounted within said hollow aperture of said rotating cap; and a push rod having a distal end, a proximate end and a middle section, said push rod attached to said second spring, said middle section of said push rod is disposed within said hollow aperture of said rotating cap, the proximate end of said push rod extends outward from the proximate end of said rotating cap, the distal end of said push rod extends outward from the distal end of said rotating cap, the distal end of said push rod extends inward into any one interior chamber of said plurality of interior chambers of said cylindrical casing, wherein the distal end of said push rod is connectable to the proximate end of any one of said cartridges of said plurality of cartridges inserted within said plurality of interior chambers of said cylindrical casing when said rotating cap is rotated around the proximate end of said casing, wherein when said rotating cap is rotated around the proximate end of said casing so that the distal end of said push rod is aligned directly over the proximate end of any one of said cartridges of said plurality of cartridges inserted within said plurality of interior chambers of said cylindrical casing then the proximate end of said push rod is operatively connected to the proximate end of said nozzle tip of the aligned cartridge so that depressing on the proximate end of said push rod fluidly connects said hollow core of said housing of said aligned cartridge of said plurality of cartridges with said manifold; and a conical applicator tip attached to the distal end of said casing, said applicator tip including:

an inside wall;

a porous wall attached to said inner wall, said porous wall having a plurality of pores traversing through said porous wall, wherein said inside wall and said porous wall defining an aft mixing chamber and a fore mixing chamber, said fore and aft mixing chambers are in fluid communications with each other, said fore and aft mixing chambers are in fluid communications with said each collar of said plurality of interior collars traversing through said manifold;

a shaft attached to said porous wall, said shaft extending through said fore mixing chamber;

a third spring attached to said shaft;

a plug seal attached to said third spring, said plug seal is detachably connected to said inside wall; and a probe having a proximate and distal ends, said probe is attached to said plug seal, when the proximate end of said probe is pushed towards said fore mixing chamber then said plug seal is detached from said inside wall of said conical applicator tip wherein the proximate end of said probe is in fluidly communications to said fore mixing chamber, when the proximate end of said probe is distended away from said fore mixing chamber then said plug seal is connected to said inside wall of said conical applicator tip wherein the proximate end of said probe is not in fluid communications with said fore mixing chamber.

12. The device of claim 11 wherein said dye concoction is selected from the group consisting of C.I. Acid Blue 1, C.I. Acid Blue 9, C.I. Acid Blue 74, C.I. Acid Blue 92, C.I. Acid Blue 93, C.I. Acid Green 3, C.I. Acid Green 5, C.I. Acid Green 25, C.I. Acid Orange 5, C.I. Acid Orange 6, C.I. Acid Orange 7, C.I. Acid Orange 11, C.I. Acid Orange 20, C.I. Acid Orange 52, C.I. Acid Orange 137, C.I. Acid Red 2, C.I. Acid Red 27, C.I. Acid Red 51, C.I. Acid Red 87, C.I. Acid Red 91, C.I. Acid Red 94, C.I. Acid Red 95, C.I. Acid Red 176, C.I. Acid Violet 19, C.I. Acid Violet 25, C.I. Acid Yellow 1, C.I. Acid Yellow 3, C.I. Acid Yellow 23, C.I. Acid Yellow 36, C.I. Acid Yellow 40, C.I. Acid Yellow 73, C.I. Basic Blue 9, C.I. Basic Blue 17, C.I. Basic Brown 1, C.I. Basic Brown 4, C.I. Basic Green 1, C.I. Basic Green 4, C.I. Basic Orange 2, C.I. Basic Red 5, C.I. Basic Violet 3, C.I. Basic Violet 10, C.I. Basic Violet 14, C.I. Direct Blue 8, C.I. Direct Blue 14, C.I. Direct Blue 53, C.I. Direct Red 2, C.I. Direct Red 28, C.I. Direct Red 34, C.I. Direct Yellow 9, C.I. Mordant Black 11, C.I. Mordant Blue 10, C.I. Mordant Blue 14, C.I. Mordant Orange 1, C.I. Mordant Orange 14, C.I. Mordant Red 3, C.I. Mordant Red 11, C.I. Mordant Violet 26, C.I. Mordant Yellow 1, C.I. Mordant Yellow 5, C.I. Natural Brown 1, C.I. Natural Brown 7, C.I. Natural Red 3, C.I. Natural Red 4, C.I. Natural Red 8, C.I. Natural Red 16, C.I. Natural Red 20, C.I. Natural Red 24, C.I. Natural Red 25, C.I. Natural Red 26, C.I. Natural Yellow 8, C.I. Natural Yellow 11, C.I. Pigment Blue 15, C.I. Pigment Blue 27, C.I. Pigment Blue 29, C.I. Pigment Blue 66, C.I. Pigment Brown 9, C.I. Pigment Green 17, C.I. Pigment Green 21, C.I. Pigment Red 83, C.I. Pigment Red 105, C.I. Pigment Red 106, C.I. Pigment Red 109, C.I. Pigment Violet 14, C.I. Pigment White 1, C.I. Pigment White 4, C.I. Pigment White 5, C.I. Pigment Yellow 31, C.I. Pigment Yellow 33, C.I. Pigment Yellow 34, C.I. Pigment Yellow 36, C.I. Pigment Yellow 39, C.I. Pigment Yellow 40, C.I. Pigment Yellow 45, and mixtures thereof.

13. The device of claim 11 wherein said housing of said plurality of cartridges is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

14. The device of claim 11 wherein said cylindrical casing is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

15. The device of claim 11 wherein said manifold is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

16. The device of claim 11 wherein said rotating cap is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

17. The device of claim 11 wherein said push rod is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

18. A method of using a fabric repair coloring device for coloring unwanted bleached out spots on fabric, said method comprising the steps of:

obtaining the device comprising:

a plurality of cartridges, each cartridge having a distal and proximate ends, each cartridge including:

a housing having a distal and proximate ends, the housing including:

a sleeve in the distal end of the housing, the sleeve defining a hole in the distal end of the housing;

an internal wall attached to the sleeve, the internal wall defining a centrally disposed hollow core in the housing; and a fluidized dye concoction contained within the hollow core in the housing;

a first spring attached to the internal wall of the housing; and a nozzle tip having a distal and proximate ends, the proximate end of the nozzle tip is attached to the first spring, a middle portion the nozzle tip is slidably inserted within the hole in the distal end of the housing, the nozzle tip having a hollow channel traversing from an exit port in the distal end of the nozzle tip to an entrance port in a side wall in the middle portion of the nozzle tip, when the proximate end of the nozzle tip is depressed inwardly into the hollow core of the housing so that the entrance port of the hollow channel in the side wall of the middle portion of the nozzle tip is within the hollow core of the housing then the exit port of the hollow channel of the nozzle tip is in fluid communications with the hollow core of the housing, when the distal end of the nozzle tip is distended outwardly away form the distal end of the housing so that the entrance port of the hollow channel in the side wall of the middle portion of the nozzle tip is outside of the hollow core of the housing then the exit port of the hollow channel of the nozzle tip is not in fluid communications with the hollow core of the housing;

wherein the plurality of cartridges comprises a first cartridge with the corresponding dye concoction having a first coloration, a second cartridge with the corresponding dye concoction having a second coloration, and a third cartridge with the corresponding dye concoction having a third coloration;

an elongated cylindrical casing having a distal and proximate ends, the casing including a plurality of interior walls defining a plurality of interior chambers, wherein each cartridge of the plurality of cartridges is slidably inserted within each corresponding interior chamber of the plurality of internal chambers of the casing;

a manifold attached to the distal end of the casing, the manifold having a plurality of interior collars traversing through the manifold, each collar having a wide section and a narrow section, the nozzle tip of each cartridge of the plurality of cartridges is slidably inserted within the wide section of each corresponding collar of the plurality of collars of the manifold, wherein the exit port of the nozzle tip is in fluid communications with the wide and narrow sections of each corresponding collar of the plurality of collars of the manifold;

a rotating cap having a proximate and distal ends, the rotating cap pivotally attached to the proximate end of the casing, wherein the rotating cap is rotatable around the proximate end of the casing, the rotating cap including:

an inner wall defining a hollow aperture;

a second spring attached to the inner wall, the second spring mounted within the hollow aperture of the rotating cap; and a push rod having a distal end, a proximate end and a middle section, the push rod attached to the second spring, the middle section of the push rod is disposed within the hollow aperture of the rotating cap, the proximate end of the push rod extends outward from the proximate end of the rotating cap, the distal end of the push rod extends outward from the distal end of the rotating cap, the distal end of the push rod extends inward into any one interior chamber of the plurality of interior chambers of the cylindrical casing, wherein the distal end of the push rod is connectable to the proximate end of any one of the cartridges of the plurality of cartridges inserted within the plurality of interior chambers of the cylindrical casing when the rotating cap is rotated around the proximate end of the casing, wherein when the rotating cap is rotated around the proximate end of the casing so that the distal end of the push rod is aligned directly over the proximate end of any one of the cartridges of the plurality of cartridges inserted within the plurality of interior chambers of the cylindrical casing then the proximate end of the push rod is operatively connected to the proximate end of the nozzle tip of the aligned cartridge so that depressing on the proximate end of the push rod fluidly connects the hollow core of the housing of the aligned cartridge of the plurality of cartridges with the manifold; and a conical applicator tip attached to the distal end of the casing, the applicator tip including:

an inside wall;

a porous wall attached to the inner wall, the porous wall having a plurality of pores traversing through the porous wall, wherein the inside wall and the porous wall defining an aft mixing chamber and a fore mixing chamber, the fore and aft mixing chambers are in fluid communications with each other, the fore and aft mixing chambers are in fluid communications with the each collar of the plurality of interior collars traversing through the manifold;

a shaft attached to the porous wall, the shaft extending through the fore mixing chamber;

a third spring attached to the shaft;

a plug seal attached to the third spring, the plug seal is detachably connected to the inside wall; and a probe having a proximate and distal ends, the probe is attached to the plug seal, when the proximate end of the probe is pushed towards the fore mixing chamber then the plug seal is detached from the inside wall of the conical applicator tip wherein the proximate end of the probe is in fluidly communications to the fore mixing chamber, when the proximate end of the probe is distended away from the fore mixing chamber then the plug seal is connected to the inside wall of the conical applicator tip wherein the proximate end of the probe is not in fluid communications with the fore mixing chamber;

finding a first piece of colored clothing having a first coloration and a first bleach spot;

twisting rotationally the rotating cap so that the distal end of the push rod is aligned directly over the proximate end of the first cartridge of the plurality of cartridges inserted within the plurality of interior chambers of the cylindrical casing;

pushing down onto the proximate end of the push rod so that the distal end of the push rod forces the proximate end of the nozzle tip of the first cartridge to slidably depress inwardly into the hollow core of the housing of the first cartridge so that the entrance port of the hollow channel in the side wall of the nozzle tip of the first cartridge is in fluid communications with the hollow core of the housing of the first cartridge wherein allowing the dye concoction in the hollow chamber of the first cartridge to flow through the manifold and into the aft mixing chamber of the applicator tip;

pressing down on the first bleach spot of the first piece of clothing with the probe so that the proximate end of the probe is forced towards the fore mixing chamber wherein allowing a portion of the dye concoction in the aft mixing chamber to flow into the fore mixing chamber of the applicator tip and out of the applicator tip onto the first bleach spot of the first piece of clothing;

releasing the proximate end of the push rod so that the first spring of the first cartridge is allowed to force the distal end of the nozzle tip of the first cartridge to distend outwardly away from the distal end of the housing of the first cartridge so that the entrance port of the hollow channel in the side wall of the middle portion of the nozzle tip of the first cartridge is outside of the hollow core of the housing of the first cartridge;

withdrawing the device from the first piece of clothing; and wiping off the applicator tip to remove any residual dye concoction.

19. The method of claim 18 further comprising the steps of:

locating a second piece of colored clothing having a second coloration and a second bleach spot;

revolving rotationally the rotating cap so that the distal end of the push rod is aligned directly over the proximate end of the second cartridge of the plurality of cartridges inserted within the plurality of interior chambers of the cylindrical casing;

driving down onto the proximate end of the push rod so that the distal end of the push rod forces the proximate end of the nozzle tip of the second cartridge to slidably depress inwardly into the hollow core of the housing of the second cartridge so that the entrance port of the hollow channel in the side wall of the nozzle tip of the second cartridge is in fluid communications with the hollow core of the housing of the second cartridge wherein allowing the dye concoction in the hollow chamber of the second cartridge to flow through the manifold and into the aft mixing chamber of the applicator tip;

depressing on the second bleach spot of the second piece of clothing with the probe so that the proximate end of the probe is forced towards the fore mixing chamber wherein allowing a portion of the dye concoction in the aft mixing chamber to flow into the fore mixing chamber of the applicator tip and out of the applicator tip onto the second bleach spot of the second piece of clothing;

freeing up the proximate end of the push rod so that the first spring of the second cartridge is allowed to force the distal end of the nozzle tip of the second cartridge to distend outwardly away from the distal end of the housing of the second cartridge so that the entrance port of the hollow channel in the side wall of the middle portion of the nozzle tip of the second cartridge is outside of the hollow core of the housing of the second cartridge;

taking away the device from the second piece of clothing; and clearing off the applicator tip to remove any residual dye concoction.

20. The method of claim 19 further comprising the steps of:

discovering a third piece of colored clothing having a third coloration and a third bleach spot;

gyrating rotationally the rotating cap so that the distal end of the push rod is aligned directly over the proximate end of the third cartridge of the plurality of cartridges inserted within the plurality of interior chambers of the cylindrical casing;

ramming down onto the proximate end of the push rod so that the distal end of the push rod forces the proximate end of the nozzle tip of the third cartridge to slidably depress inwardly into the hollow core of the housing of the third cartridge so that the entrance port of the hollow channel in the side wall of the nozzle tip of the third cartridge is in fluid communications with the hollow core of the housing of the third cartridge wherein allowing the dye concoction in the hollow chamber of the third cartridge to flow through the manifold and into the aft mixing chamber of the applicator tip;

cramming down on the third bleach spot of the third piece of clothing with the probe so that the proximate end of the probe is forced towards the fore mixing chamber wherein allowing a portion of the dye concoction in the aft mixing chamber to flow into the fore mixing chamber of the applicator tip and out of the applicator tip onto the third bleach spot of the third piece of clothing;

discharging the proximate end of the push rod so that the first spring of the third cartridge is allowed to force the distal end of the nozzle tip of the third cartridge to distend outwardly away from the distal end of the housing of the third cartridge so that the entrance port of the hollow channel in the side wall of the middle portion of the nozzle tip of the third cartridge is outside of the hollow core of the housing of the third cartridge; and moving the device away from the third piece of clothing.

* * * * *